US010975816B2

(12) United States Patent
Pellini

(10) Patent No.: US 10,975,816 B2
(45) Date of Patent: Apr. 13, 2021

(54) ROLLER DRIVE MECHANISM FOR GDI PUMP

(71) Applicant: Stanadyne LLC, Windsor, CT (US)

(72) Inventor: Richard Paulo Pellini, South Windsor, CT (US)

(73) Assignee: Stanadyne LLC, Windsor, CT (US)

( * ) Notice: Subject to any disclaimer, the term of this patent is extended or adjusted under 35 U.S.C. 154(b) by 132 days.

(21) Appl. No.: 15/822,433

(22) Filed: Nov. 27, 2017

(65) Prior Publication Data

US 2019/0162141 A1 May 30, 2019

(51) Int. Cl.

| | |
|---|---|
| ***F02M 59/00*** | (2006.01) |
| ***F02M 59/02*** | (2006.01) |
| ***F04B 7/00*** | (2006.01) |
| ***F04B 1/0413*** | (2020.01) |
| ***F04B 1/0426*** | (2020.01) |
| ***F04B 1/053*** | (2020.01) |
| ***F02M 59/10*** | (2006.01) |
| ***F04B 17/03*** | (2006.01) |
| ***F04B 9/04*** | (2006.01) |
| ***F02M 63/00*** | (2006.01) |
| *F04B 49/20* | (2006.01) |
| *F04B 49/06* | (2006.01) |

(52) U.S. Cl.

CPC ..... *F02M 59/027* (2013.01); *F02M 59/102* (2013.01); *F02M 63/0001* (2013.01); *F04B 1/0413* (2013.01); *F04B 1/0426* (2013.01); *F04B 1/053* (2013.01); *F04B 7/0061* (2013.01); *F04B 9/042* (2013.01); *F04B 17/03* (2013.01); *F02M 2200/26* (2013.01); *F04B 49/06* (2013.01); *F04B 49/20* (2013.01)

(58) Field of Classification Search

CPC .. F01B 1/062; F01B 9/02; F02B 75/32; F02B 39/04; F02B 39/10; F02M 59/44; F02M 59/027; F02M 59/38; F02M 37/06; F02M 37/08; F04B 1/0404; F04B 7/0061

See application file for complete search history.

(56) References Cited

U.S. PATENT DOCUMENTS 4,339,234 A * 7/1982 Williams ..... F02M 59/102 417/490
5,315,967 A * 5/1994 Schoell ..... F01B 1/062 123/54.3
5,701,873 A * 12/1997 Schneider ..... F02M 59/34 123/462
5,839,411 A * 11/1998 Schoell ..... F01B 1/062 123/446
6,805,538 B2 10/2004 Djordjevic (Continued)

*Primary Examiner* — Gonzalo Laguarda
(74) *Attorney, Agent, or Firm* — Alix, Yale & Ristas, LLP

(57) ABSTRACT

In a high pressure fuel supply system, a variable speed motor asynchronously actuates a pumping piston with a drive mechanism including a circular cam with cam roller, having an axis that is offset from the axis of the cam drive shaft. A rolling or sliding cam follower is rigidly connected to the piston, and a piston retainer is operatively connected among the piston, the cam follower and the cam roller. As the cam shaft rotates, the cam roller rotates eccentrically relative to the cam shaft while maintaining contact with the cam follower, thereby reciprocating the follower and the piston along the actuation axis, in corresponding charging and pumping strokes of the piston.

18 Claims, 12 Drawing Sheets

(56) References Cited

U.S. PATENT DOCUMENTS

| | | | | |
|---|---|---|---|---|
| 8,007,251 | B2 | 8/2011 | Djordjevic | |
| 9,353,716 | B2 * | 5/2016 | Sato | F02M 39/005 |
| 2009/0120280 | A1 * | 5/2009 | Takamizawa | F02M 59/06 92/72 |
| 2010/0170480 | A1 * | 7/2010 | Maier | F02M 63/0001 123/508 |
| 2011/0100312 | A1 * | 5/2011 | Hirata | F01L 1/022 123/90.17 |
| 2012/0031357 | A1 * | 2/2012 | Ervin | F02D 41/1498 123/90.11 |

* cited by examiner

ROLLER DRIVE MECHANISM FOR GDI PUMP

BACKGROUND

The present invention relates to single piston, high pressure fuel supply pumps for direct injection gasoline engines.

The prevalent architecture for a Direct Injection (DI) fuel supply system synchronizes the pumping events with the injection events. This is desirable to minimize the pressure variation on the DI common rail. The coupling is normally accomplished directly by the number of lobes on the actuating cam of the high pressure pump (HPP). Because the cam is normally driven by a mechanical shaft (driveshaft) at an integer ratio to the engine crankshaft, the HPP is synchronized to the engine piston position (and the injection event) both in speed and in the position of the HPP piston.

Recent DI control strategies decouple the mechanical drive for HPP from the engine powertrain, and the HPP is driven by a separate actuator such as an electrical motor. The decoupling of the HPP from the engine implies that the HPP could run at an asynchronous ratio to the engine injection. The electrical drive is not limited by the engine speed, and it could have a much high speed than normally found in engine-driven mechanical systems.

The common drive system utilizes three or four-lobe cams for four-stroke engines of four, six, or eight cylinders. In the case of an electrical motor drive, and because of its speed flexibility, it is possible to drive the HPP with a single-lobe actuation cam and deliver an equivalent fuel flow rate to the rail. Rail pressure control is simplified if the pumping ratio is above the injection ratio.

SUMMARY

The object of the present invention is to simplify the asynchronous actuation of the pumping piston by providing a circular cam having an axis that is offset or eccentric to the axis of the cam drive shaft.

In the disclosed embodiment, a cam shaft extends along a cam shaft axis that is perpendicular to and intersects the actuation axis of the piston, and a circular cam is rigidly connected with the camshaft, having a cam axis that is perpendicular to and intersects the actuation axis, and is offset from the cam shaft axis. A circular cam roller surrounds the cam and a cam bearing is interposed between the cam roller and the cam. A cam follower is rigidly connected to the piston, and a piston retainer is operatively connected among the piston, the cam follower and the cam roller. As the cam shaft rotates, the cam roller rotates eccentrically relative to the cam shaft while maintaining contact with the follower, thereby reciprocating the follower and the piston along the actuation axis, in corresponding charging and pumping strokes of the piston.

The cam follower can be a roller type or a slider type.

The cam follower roller embodiment is sized and configured based on the rolling contact stress between the cam roller and cam follower roller, and the velocity of the cam follower roller bearing. The velocity of the bearing is typically the dominant factor. The surface speed at the contact point is a function of the cam velocity and profile, and the cam size. Because on the traditional cam/cam follower roller the cam does not rotate, the rotational speed of the cam follower roller is high (that assumes that there is no slipping at the contact point, which is highly detrimental due to wear). This pushes the design of the cam follower roller to an increased bearing contact area, as is typical for a GDI pump follower.

This is accomplished in the prior art by: (i) Increasing the diameter of the bearing, which in turn increases the diameter of the cam follower roller, which increased the size of the cam; (ii) changing the cam follower roller bearing arrangement such that there is a secondary bearing inserted into the primary bearing; (iii) changing the cam follower roller bearing design from a sliding journal to a roller-bearing type (or multiple roller-bearing nested); (iv) increasing the width of the bearing; and/or (v) changing the materials of the bearing to allow for larger loads, with a material having higher contact stress tolerance or specialized coatings. All these alternatives add cost to the product, such as increasing the size and weight of the components or adding complexity to the lubrication of the cam follower roller bearing. This is a non-trivial effort considering the reciprocating nature of the bearing, the speeds involved, the sizes and geometry of the bearing, etc.

The presently disclosed drive system with cam follower roller provides several advantages:

(1) By adding the rolling function to the cam roller the bearing design (now the cam roller bearing) can be more robust (especially on an occupied volume that affords more space). By increasing the bearing capacity, the width of the cam roller and, consequently, the diameter of the cam follower can be reduced as well.

(2) The size and complexity of the cam follower roller bearing can be simplified and made more reliable. This is important, because lubrication to this bearing is difficult.

(3) The contact velocity is substantially decreased, reducing the rotation velocity of the cam follower roller because both the cam roller and cam follower roller need only to rotate about the contact arc between them; all the bearing velocity is carried by the cam roller bearing.

(4) Durability is improved by the increased robustness of the bearing capabilities.

The cam follower slider embodiment is sized and configured based on the sliding bearing capacity between the cam and the face of the cam follower. This drives into a cam follower of even larger contact between the pair (because wear mechanisms at sliding are more severe than at rolling). This is a typical design for an engine valve over-head camshaft. GDI applications of this typical design are only for very small pumps, with low loads, and it is very uncommon.

This is accomplished in the prior art by (i) increasing the contact line between cam and cam follower, thus increasing the width of both; (ii) increasing the radii of both cam and cam follower particularly where the stresses are higher (this is to reduce the Hertzian stresses) but this also increased the sliding velocity at the contact point; and (iii) using materials and/or coatings more robust to sliding wear.

The presently disclosed drive system with cam follower slider provides several advantages:

(1) Provides a viable alternative for higher load (larger/higher pressure GDI pump).

(2) By adding the rolling function to the cam roller the bearing design shifts from a slide-bearing design to a roller-bearing design. This is because both cam roller and cam follower roller need only to rotate in relation to each other about the contact arc between them; all the bearing velocity is carried by the cam roller bearing.

(3) By adding the rolling function to the cam roller the bearing design can be more robust (especially on an occupied volume that affords more space). By increasing the bearing capacity, the width of the cam roller and, consequently, the diameter of the cam follower can be reduced as well.

(4) The size of the cam roller and cam follower face can be substantially reduced because it no longer needs slide capabilities.

(5) The contact velocity is substantially reduced, because the cam roller need only to rotate about the contact arc between it and the cam follower face; all the bearing velocity is carried by the cam roller bearing.

(6) Durability is improved by the increased robustness of the bearing capabilities.

The presently disclosed GDI pump features a more compact, lighter, yet more robust drive system, with a simplicity that reduces the reciprocating masses and results in less vibration and less mechanical noise. One embodiment eliminates the need of a cam follower. Also, the piston velocities and accelerations are reduced at the beginning and at the end of the stroke. This is a consequence of the sinusoidal (or near-sinusoidal) cam profile. This minimizes hydraulic noise generated by the pump because the opening and closing of the valves is at lower speeds and accelerations, and improves durability of the pump components and drive system.

A variable speed electric motor is connected to the cam shaft for actuating the cam. The pump is connected to a fuel supply circuit including a common rail, and the fuel supply system is connected to an electronic control unit that receives input signals commensurate with fuel pressure in the common rail, engine speed, and cam rotation position. The electronic control unit delivers a control signal to the variable speed electric motor for rotating the cam at a speed different from the engine speed.

BRIEF DESCRIPTION OF THE DRAWING

Embodiments of the invention will be described below with reference to the accompanying drawing, in which.

DETAILED DESCRIPTION

Figure 1:
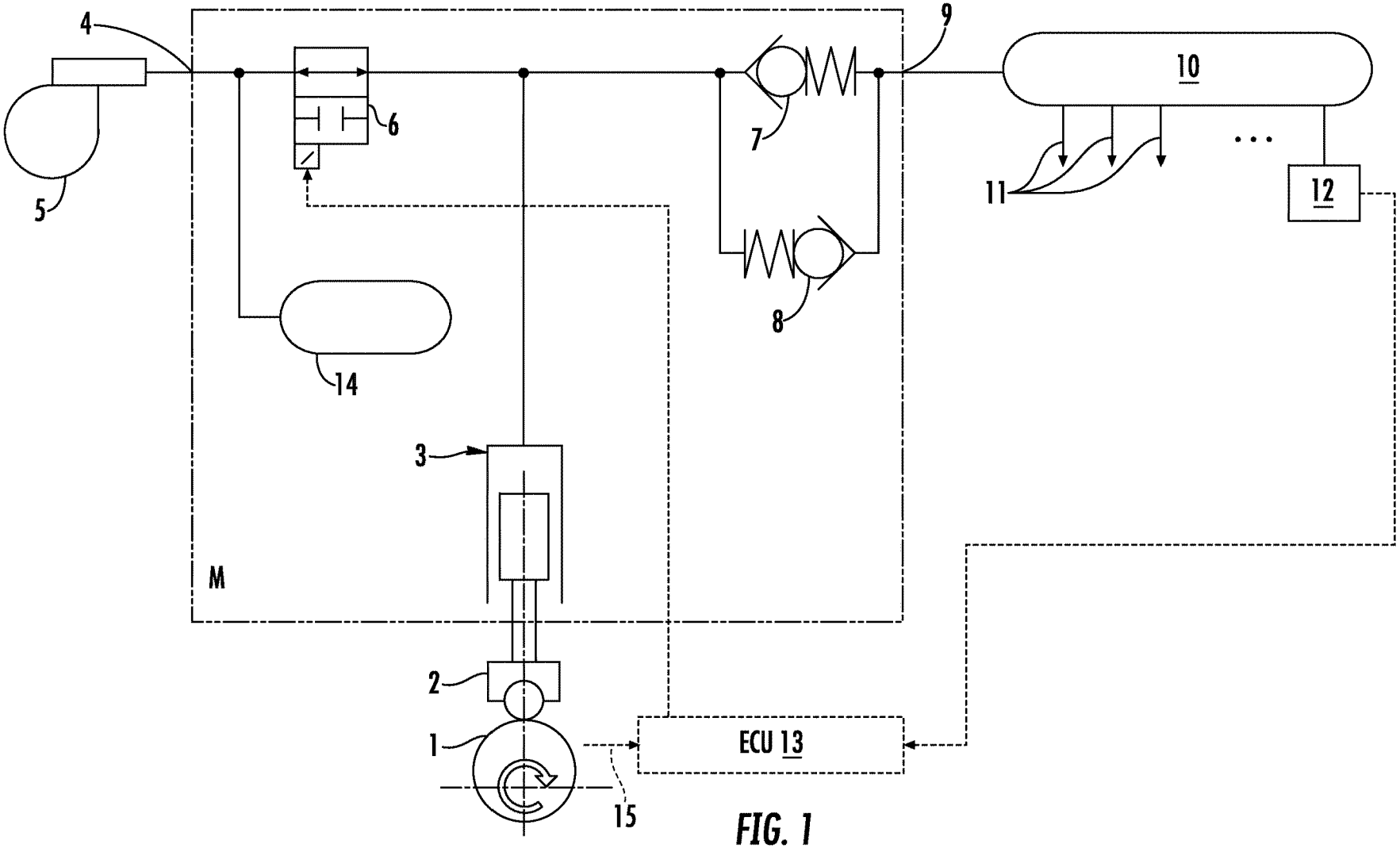
FIG. 1 is a schematic of the hydraulic circuit with associated control, in accordance with one implementation of the invention.

A representative hydraulic circuit for implementing the present invention is shown in FIG. 1. The HPP module or body is indicated by the bold outline designated as M.

The pump has an inlet 4 for receiving low-pressure feed fuel from the low pressure pump 5. A bore in the body partially defines a pumping chamber, which has an associated piston 3. The feed fuel passes through the inlet control valve 6 into the pumping chamber. One end of the pumping piston further defines the pumping chamber and the other end projects out of the body for reciprocal driving by a rotating cam 1. The pumping chamber is fluidly connected to outlet check valve 7 and associated overpressure relief valve 8.

The pumped high pressure fuel from the outlet check valve 7 passes through an outlet port 9 to the common rail 10, which is in fluid communication with a plurality of direct injectors 11. A pressure sensor 12 is associated with the common rail to deliver a signal to the electronic control unit 13 (ECU). The ECU also receives a signal commensurate with a cam position sensor 15 for opening or closing the inlet control valve 6.

In a typical implementation, the low pressure pump 6 provides inlet or feed fuel at a pressure of about 5 bar, whereas the direct injection system in the common rail 10 is maintained at a target pressure of about 350 bar.

In the illustrated system, quantity control is managed by the timing of the opening and closing of control valve 6 in relation to the position of the piston 3 within the pumping chamber, as inferred from the cam position sensor 15. In a spill-fill type metering control, the control valve 6 remains open during the original pressurizing displacement of the piston, thereby returning fuel at a relatively low pressure to the low pressure pump 5 or the inlet accumulator 14. At the moment as determined by the ECU, the control valve 6 closes and the fuel remaining in the pumping chamber is compressed by the piston 3 and delivered through the outlet check valve 7 to the common rail 10, in a metered quantity. The control valve 6 is shown as a two port, two position, normally open, directly actuated flow control valve.

Figure 2:
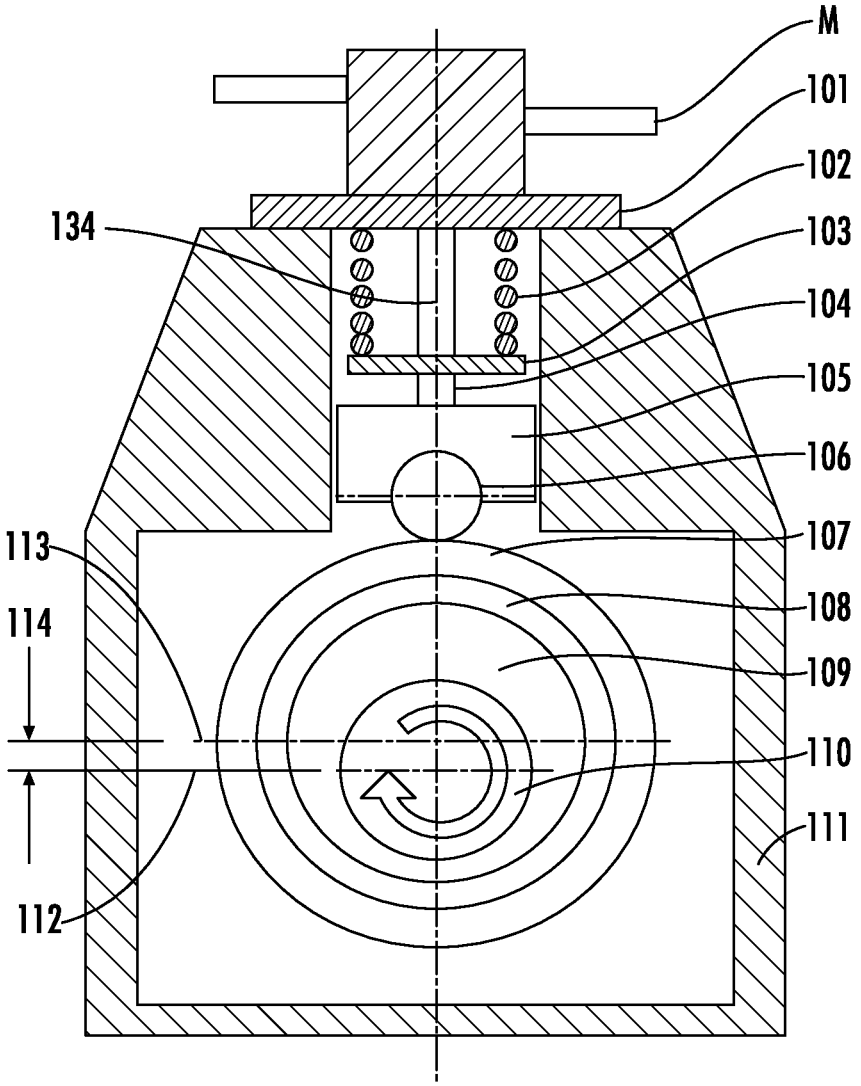
FIG. 2 is a schematic of a first embodiment of a roller actuated pump according to the invention, including a cam follower with cam following roller.

As schematically depicted in FIG. 2, the inlet, outlet and body of the pump module are generally indicated at M, with the elements that are attached to the pump for actuating the pumping piston, carrying three-digit numeric identification. The actuating components are encapsulated within a housing 111 that is connected to the pump module M through a pump mounting flange 101. The housing has a bore containing the piston return spring 102, piston return spring retainer 103 and the stem or other extension 104 of the piston. The piston portion 104 is in contact with a cam follower 105 which, in FIG. 2, includes a cam follower roller 106. These components are aligned on an actuation axis 134, which is the same as the reciprocation axis of the piston. The cam follower roller 106 is in contact with a circular cam roller 107, which in the illustrated embodiment has a cam roller bearing 108 between it and the cam 109. The cam 109 is driven by a camshaft 110 around a camshaft axis 112. The common axis 113 of the concentric cam roller 107, cam roller bearing 108 and cam 109 is offset from the camshaft axis 112, producing an eccentricity indicated at 114. The camshaft axis 112 and cam axis 113 are parallel and are both intersected by the actuation axis 134.

The piston 104 is attached to the piston return spring 102 by means of the retainer 103 and extends to the cam follower 105 such that the piston is in permanent contact with the cam follower, which in turn has a surface that is in constant contact with tappet means, such as the cam roller 107.

The cam 109 is attached to the 110 camshaft, such that the cam follower 105 is at a maximum of its stroke when the cam is at top dead center (TDC) and at the minimum of its stroke when the cam is at bottom dead center (BDC). The difference between TDC and BDC is the full stroke. In this manner, the apex position of the cam roller 107 in contact with the cam roller follower 106, rises and falls relative to the camshaft axis 110 and thus actuates a pressurizing stroke and a charging stroke respectively of the piston in the pumping chamber, i.e., the cam can be considered as moving between top dead center and bottom dead center during the charging stroke and between bottom dead center to the top dead center during the pressurizing stroke of the piston.

The roller 106 can rotate within the follower body 105. Because the cam roller 107 is also able to rotate on the cam 109, the tangential speeds at the contact of the cam follower roller 106 and the cam roller 107 can be substantially reduced.

The cam roller bearing 108 may be a sliding journal situated in the diametric clearance between the cam 109 and the cam roller 107, or a separate liner, with better sliding and frictional properties. Lubrication of the cam roller bearing 108 would be preferably due to a hydrodynamic film formed at the clearance, with a lubricant source provided by a forced-feed flow through cam 109.

Figure 9:
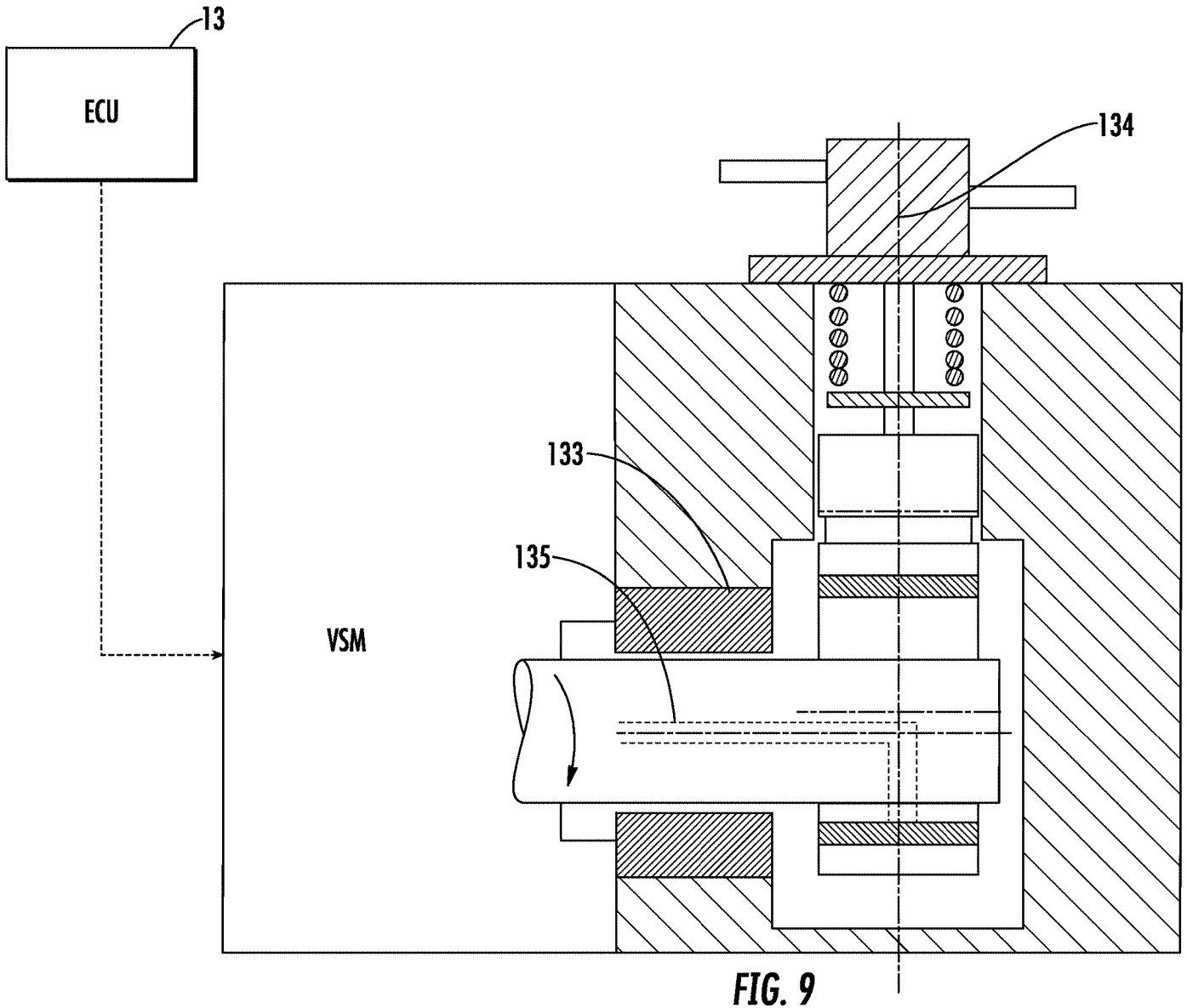
FIG. 9 is a schematic showing a cantilevered cam shaft bearing, with the cam shaft connected to a variable speed electric motor attached to the housing, under the control of the electronic control unit for rotating the cam shaft at any speed, independent of the engine rpm.

The housing 111 can be part of another system, as in the case of an engine block or an engine valve cover, or an independent drive system, such as an electrical motor (as shown in FIG. 9).

The eccentricity 114 is the distance between the rotating axes 112, 113 of the camshaft and the cam. Because the cam is circular, the eccentricity is half of the stroke.

Figure 3:
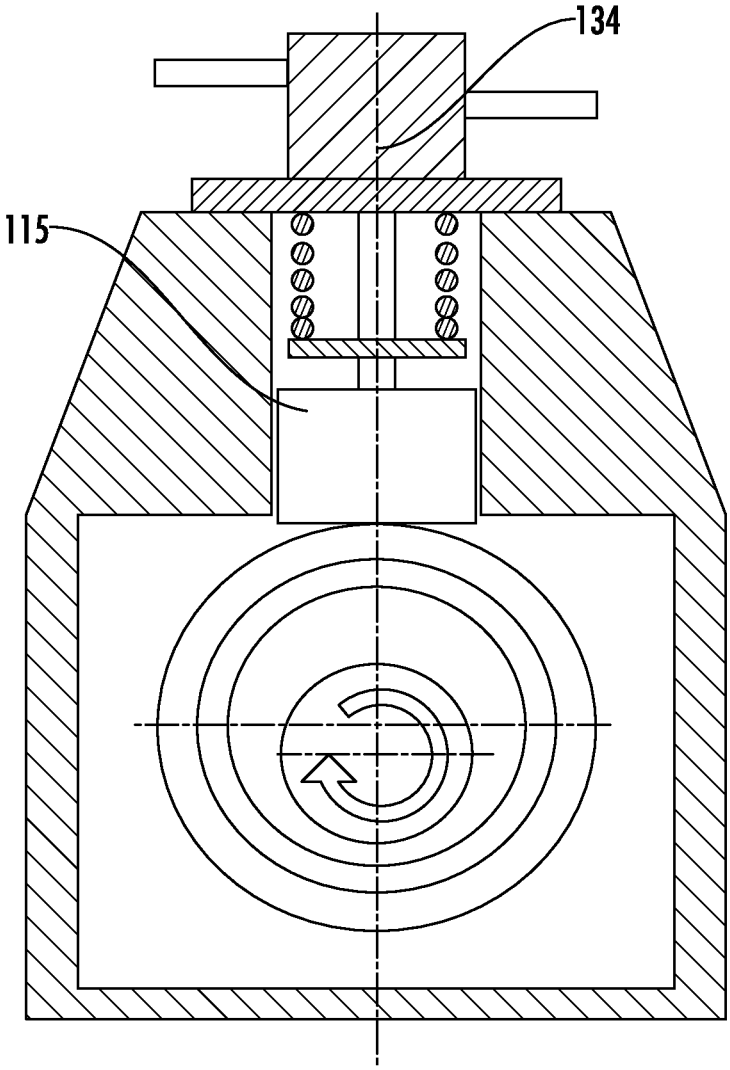
FIG. 3 is a schematic of another cam roller embodiment in which the follower is a slider.

FIG. 3 shows a different embodiment, in which the cam follower is a slider 115, rather than including a roller such as 106 shown in FIG. 2.

Figure 4:
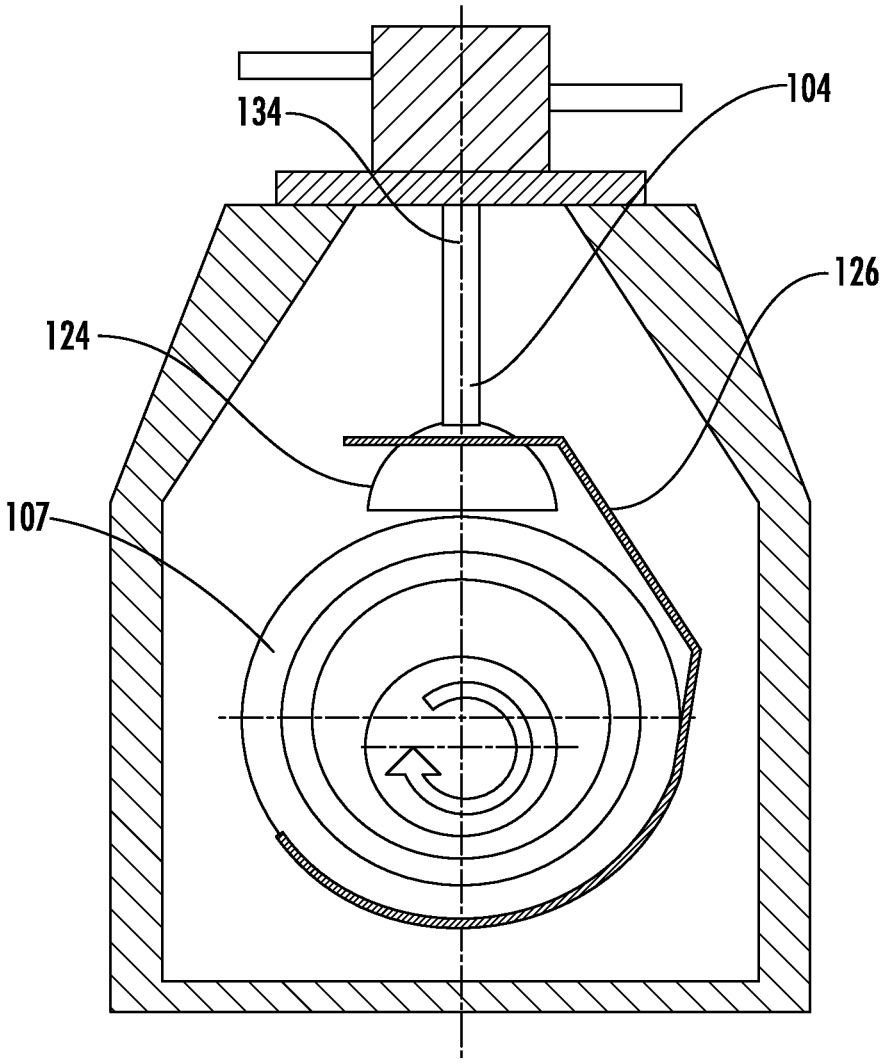
FIG. 4 is a schematic of yet another embodiment, in which the follower is a slider but a retainer spanning the cam roller and the slider replaces the piston return spring and spring retainer of the embodiments shown in FIGS. 2 and 3.

FIG. 4 shows another embodiment wherein the piston extends continuously to the cam roller, with a slider 124 at the lower end contacting the roller and a piston retainer 126 between the cam roller and the slider, replacing the piston return spring 102 as shown in FIG. 2.

Figure 6:
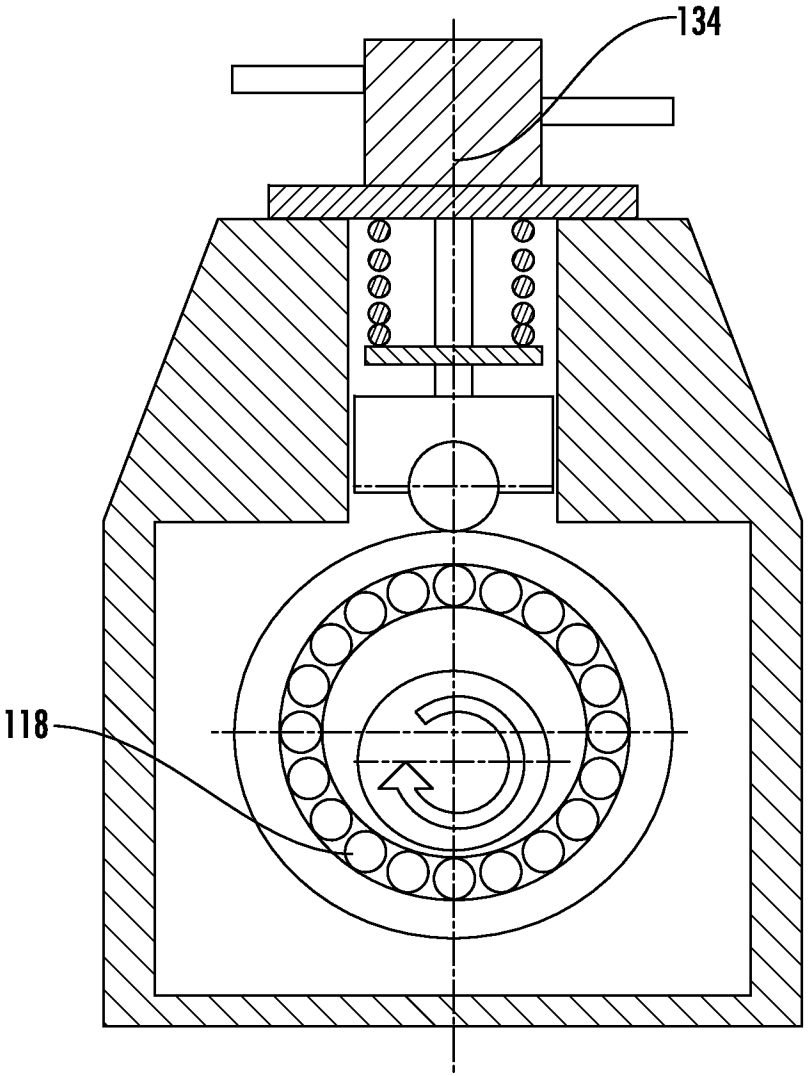
FIG. 6 is a schematic similar to FIG. 2, wherein the bearing between the cam and the cam roller, is a ball type bearing.
Figure 5:
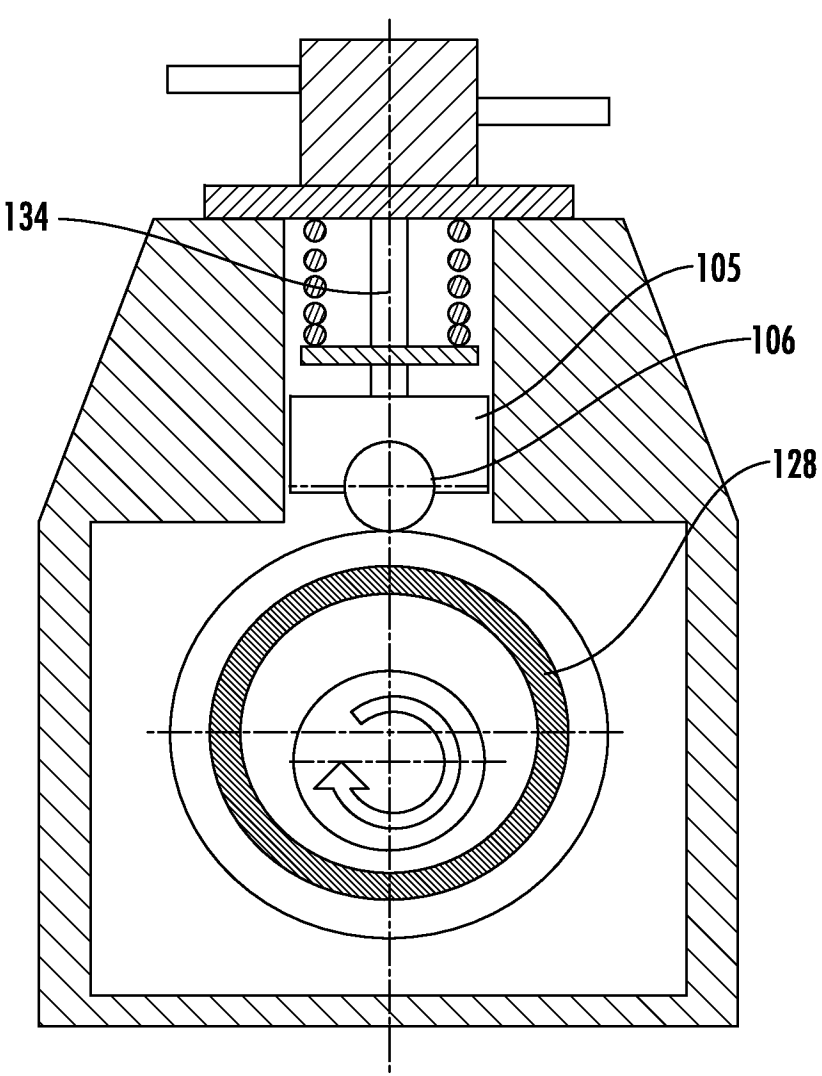
FIG. 5 is a schematic similar to FIG. 2 wherein the bearing between the cam and the cam roller is shown as a journal type bearing.

FIG. 5 specifically shows a journal type cam roller bearing 128, whereas FIG. 6 shows a roller bearing 118 that can be ball-type, roller-type, or needle type. It can be appreciated that either of the bearing types 128, 118 shown in FIGS. 5 and 6 can be employed with a slider type follower such as shown in FIGS. 3 and 4.

With reference to FIGS. 2-6 the OD on cam roller 107 may have a convex profile, such as a radius, in the axial direction centered with the axis, instead of a cylindrical form, i.e., crowned. This may reduce the contact stresses between the cam roller 107 and the cam follower roller 106 or slider 125 (Hertzian stresses). In the case of the cam follower 105, the crown may be in the cam roller follower 106, instead of the cam roller 107, or both.

In the case of a slider type follower 115, the follower contact is a plane perpendicular to the actuation axis 134. Rotating frictional forces between the cam roller 107 and the cam 109, and the sliding frictional forces between the cam roller 107 and the slider follower 115, will affect the rotation of the cam roller in the following manner. The rotating frictional forces are smaller than the sliding frictional forces, then the contact sheer forces between the cam roller 107 and the follower 115 will prevent the cam roller 107 from sliding on the face of the follower 115. The cam roller 107 will fully rotate by the contact arc formed by the eccentricity of the cam 109. If the frictional forces are greater, then the cam roller 107 will slide on the face of the follower 115. Both modes may be present during the HPP cycle. The sliding motion may not be detrimental when the contact stresses are low, as in the case of the HPP charging cycle, but could be detrimental if the contact stresses are high, as in the case of the pumping cycle. The predominant failure modes would be adhesive and abrasive wear of the cam roller 107 and/or the cam 109. As such a preferred state is one in which there is no sliding under any condition. However, a more realistic condition is one in which the sliding occurs during the HPP charging cycle (due to the low contact forces between the cam roller 107 and the follower 115) and rolling during the HPP pumping and decompression cycles (due to increased contact forces as resulting from the pressure generated by the piston 104).

In the case of the piston slider 124, the distinct cam follower 115 is deleted, and the contact plane is directly built in the piston slider 124, which is in effect a slider type cam follower. The piston retainer 126 is an elongated, angled spring that wraps more than 180 degrees around the cam follower (slider 124) and the cam roller 107.

In all the embodiments, the direct or indirect contact between the cam follower 105, 115, 124 and the cam roller 109 produces a linear reciprocation of the piston. In the slider version 115, 124 of the cam follower, the rotation of cam 109 with circular profile, reciprocates the cam follower with a sinusoidal action. In the roller version 105 of the cam follower, the action of the cam roller/follower roller pair is more complex due to the contact point between the radii of the two rollers 106, 109, and is not purely sinusoidal. However, in both embodiments the piston velocities and accelerations are reduced at the beginning and at the end of the stroke.

Figure 8:
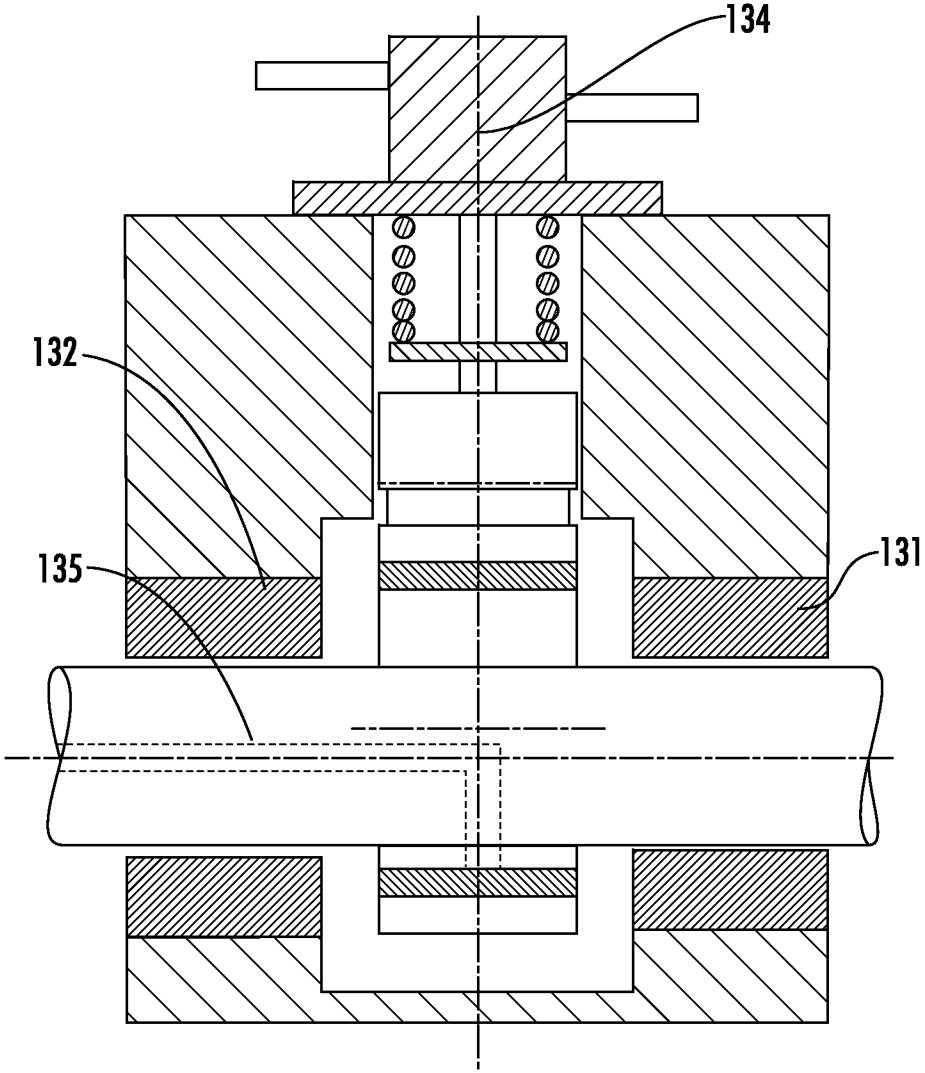
FIGS. 7 and 8 are schematics showing a balanced cam shaft bearing with associated roller journal and lubrication path.
Figure 7:
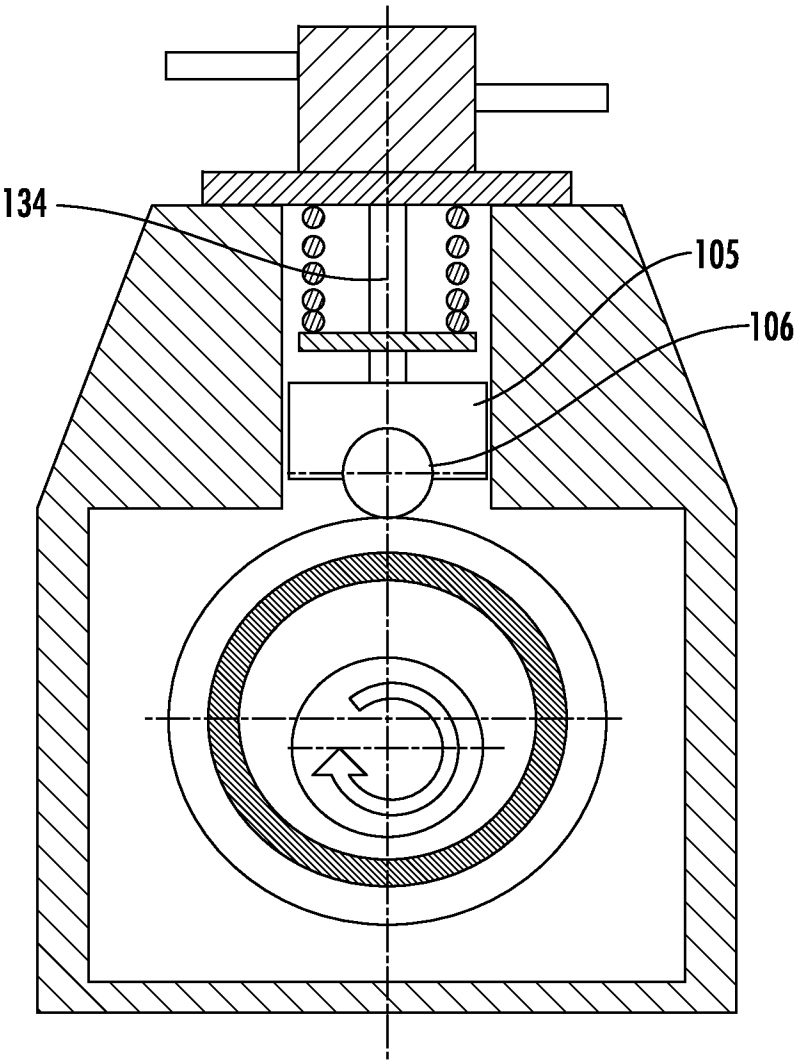

FIGS. 7 and 8 show a balanced cam shaft bearing situated around the cam shaft on the longitudinally front 131 and rear 132 sides of the actuating cam. Preferably, one or more lubrication paths 135 are provided for lubrication of the cam roller bearing such as 108 shown in FIG. 2.

FIG. 9 shows an analogous configuration, wherein the camshaft bearing is cantilevered by, i.e., a single camshaft bearing 133 on one side of the actuation cam.

FIG. 9 also shows the preference for a variable speed electric motor VSM connected to the cam shaft for actuating the cam, independently of the engine (not shown). As shown in FIG. 1, the pump M is part of a fuel supply circuit or system including a common rail 10, with injectors 11 that are fitted to the engine. The fuel supply system is connected to an ECU 13 that receives input signals commensurate with fuel pressure in the common rail 10, engine speed, and cam rotation position 15. The ECU 13 delivers a control signal to the variable speed electric motor VSM for rotating the cam at a speed different from the engine speed. Preferably, the piston retainer 103, 126, cam follower 105, 115, 126, cam roller 107, cam 109, camshaft 110 and motor VSM are situated in housing 111 that is connected to the pump body (see also FIG. 2).

The HPP pump is required to operate under three distinct conditions: (1) provide low-pressure flow from the low-pressure supply pump to the DI common rail in the event that the DI pump is inoperable (bypass, or "limp-home"

mode); (2) provide a metered amount of flow at high pressure to the DI common rail; and (3) provide zero flow to the DI common rail.

These operating conditions are shown schematically in FIGS. 10-14.

Figure 10:
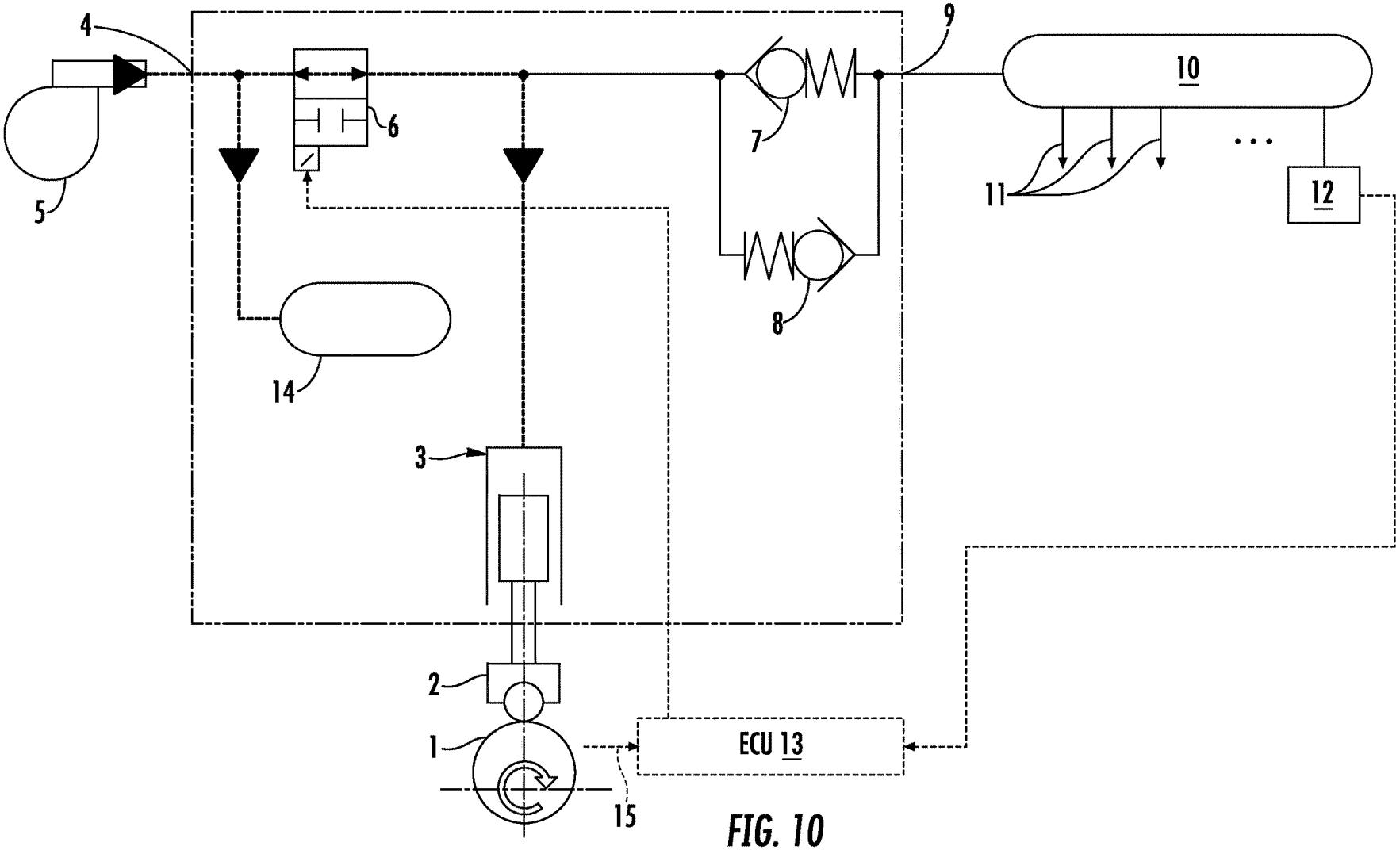
FIG. 10 corresponds to FIG. 1, showing the fluid flow during the charging cycle of the pump.

FIG. 10 shows the fuel supply and charging mode, while the pumping piston 3 is retracting in the pumping chamber.

Figure 11:
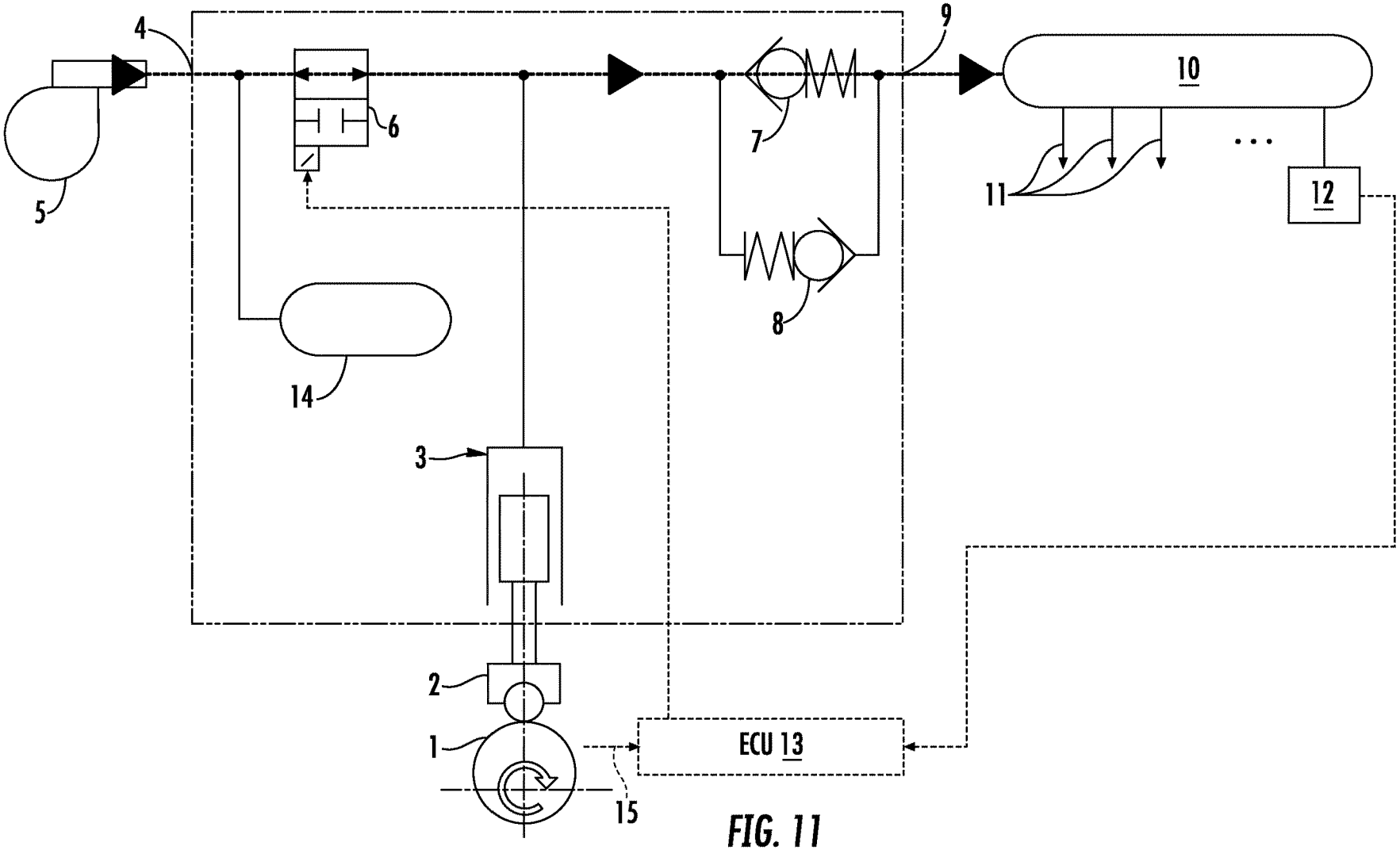
FIG. 11 corresponds to FIG. 1, showing the fluid flow during a bypass mode of operation of the pump.

FIG. 11 shows the high pressure pump bypass condition, where it is assumed that the pumping action of the piston 3 is not available or is inoperable and the low pressure feed fuel from pump 5 is delivered directly to the common rail 10.

Figure 12:
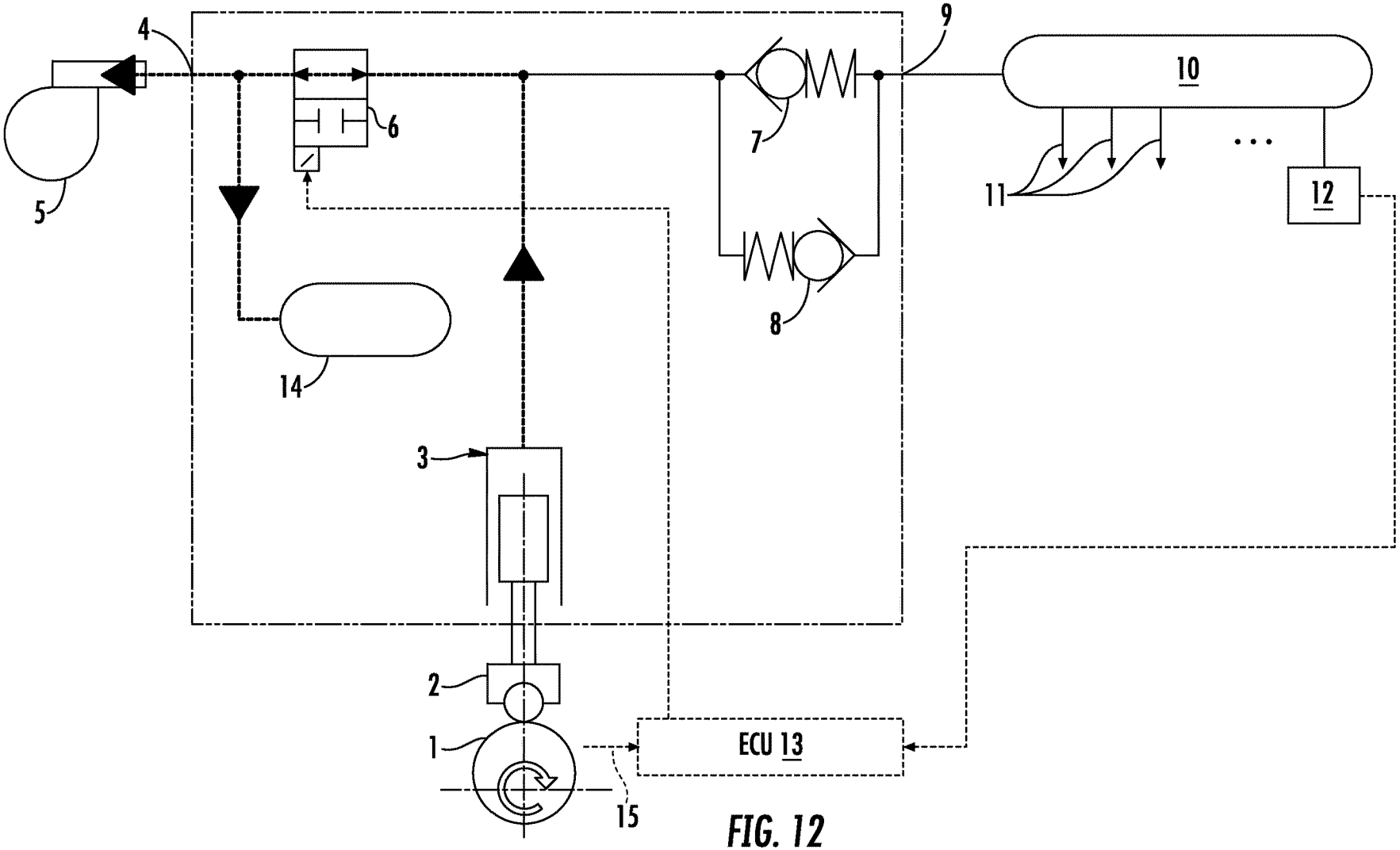
FIGS. 12 and 13 correspond to FIG. 1, showing the fluid flow sequence during the pumping stroke of the piston, wherein fuel is initially spilled and the remaining fuel is pressurized for delivery to the common rail.
Figure 13:
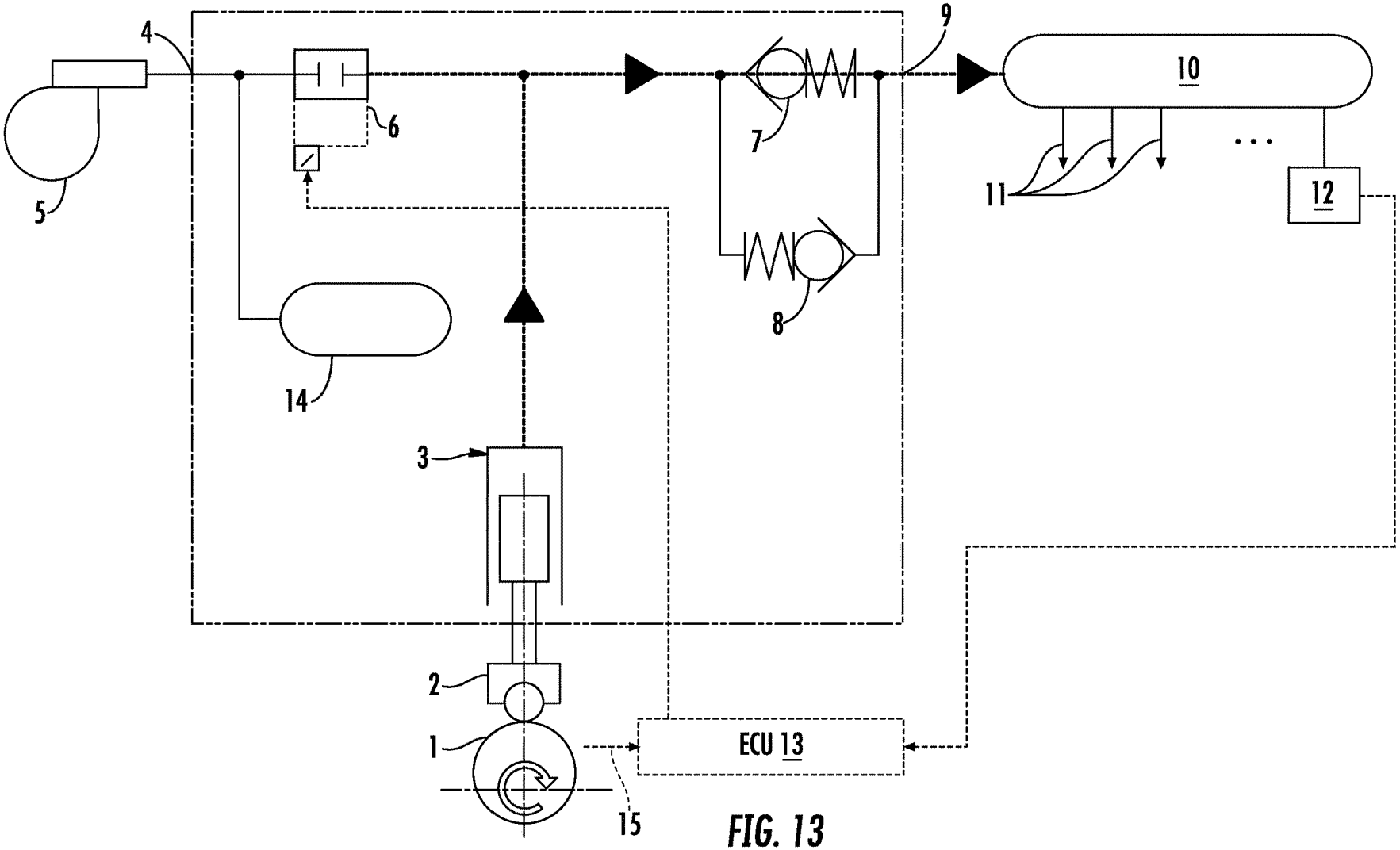

FIG. 12 shows the flow during the initial pumping stroke of the piston 3, where fuel is spilled to a low pressure region such as pump 5 and accumulator 14 while the control valve 6 is open, and FIG. 13 shows the control valve 6 closed whereby the remaining fuel in the pumping chamber is pressurized for delivery to the common rail.

Figure 14:
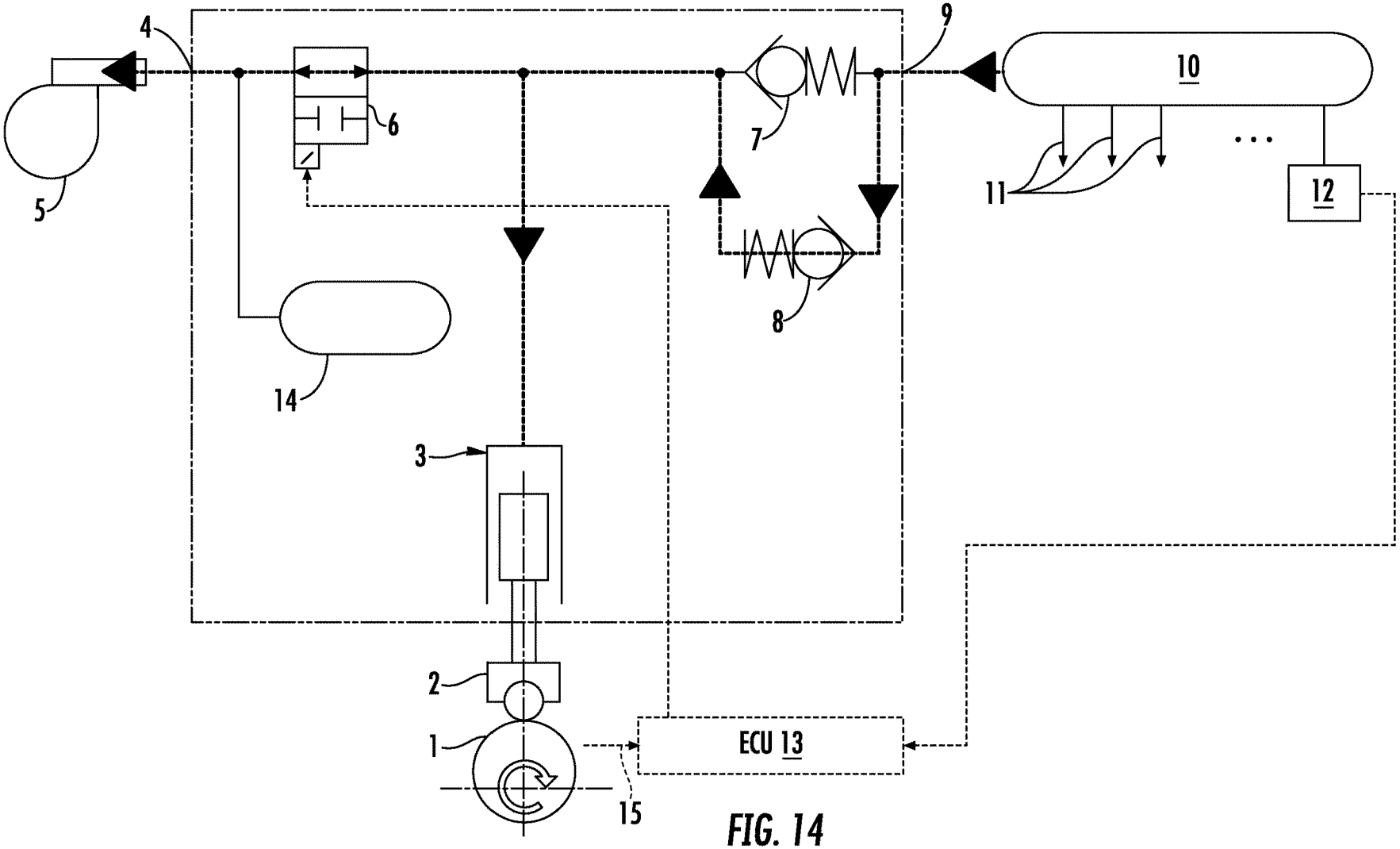
FIG. 14 corresponds to FIG. 1, showing the fluid flow during the overpressure relief condition in the common rail.

FIG. 14 shows the opening of the pressure relief valve 8, at the maximum permissible pressure of the common rail 10, whereby excessive pressure is relieved back to the pumping chamber 3, where a low pressure condition exists during the charging phase.

For a zero fueling condition, the inlet control valve 6 is de-energized and thus kept open during the entire pumping cycle, i.e., the pump is in a constant spill mode. In this mode no volume is transferred to the common rail 10 because the pumping chamber pressure is below the opening chamber pressure of the outlet check valve 7.

The invention claimed is:

1. A high pressure fuel supply pump for a gasoline direct injection engine, comprising:

a pump body;

a single pumping bore in the body, partially defining a pumping chamber;

a single pumping piston reciprocating in the bore along an actuation axis, with one end further defining the pumping chamber and another end projecting out of the body for reciprocal driving by a rotating circular cam;

an inlet valve connected to the body, wherein the inlet valve is in fluid communication with the pumping chamber;

an outlet check valve connected to the body for discharging pressurized fuel from the pumping chamber through the body during a pumping stroke of the piston;

a cam shaft outside the body, extending along a cam shaft axis that is perpendicular to and intersects the actuation axis;

the circular cam rigidly connected to the cam shaft, having a cam axis that is perpendicular to and intersects the actuation axis, and is offset from the cam shaft axis;

a circular cam roller surrounding the cam;

a cam roller bearing interposed between the circular cam roller and the cam;

a cam follower connected to the piston, wherein the cam follower includes a roller that contacts the circular cam roller with a mutually rolling relationship as the cam rotates;

a piston retainer operatively connected among the piston, the cam follower and the circular cam roller for biasing the piston and cam follower toward the circular cam roller; and a variable speed electric motor operatively connected to rotate said cam shaft and said circular cam independently of the gasoline direct injection engine, wherein the variable speed electric motor is situated in a housing that is connected to the pump body, whereby as the cam shaft continuously rotates, the circular cam roller rotates eccentrically relative to the cam shaft and through the piston retainer and cam follower, converts the rotating motion of the cam shaft into a linearly reciprocal stroke of the piston in the pumping chamber.

2. The pump of claim 1, wherein the piston retainer maintains a direct transfer of force between the circular cam roller and the piston such that the piston stroke follows a sinusoidal rate of displacement though a fully charging stroke and a fully pumping stroke corresponding to cam rotation between bottom dead center and top dead center.

3. The pump of claim 1, wherein the pump is connected to a fuel supply circuit including a common rail;

the fuel supply circuit is connected to an electronic control unit that receives input signals commensurate with fuel pressure in the common rail, engine speed, and a rotational position of the cam; and the electronic control unit delivers a control signal to the variable speed electric motor for rotating the cam at a speed different from the engine speed.

4. The pump of claim 1, wherein the cam follower defines a flat face that contacts the circular cam roller with a sliding relationship as the cam rotates.

5. The pump of claim 4, wherein the piston retainer is a spring that wraps more than 180 degrees around the cam follower and the circular cam roller.

6. The pump of claim 1, wherein the cam roller bearing is a journal bearing.

7. The pump of claim 1, wherein the cam roller bearing is selected from the group consisting of ball-type, roller-type, or needle type.

8. The pump of claim 1, wherein during one rotation of the cam shaft the piston is reciprocally displaced through a charging stroke between top dead center and bottom dead center and a pumping stroke between bottom dead center and top dead center and the piston stroke follows a rate of displacement that decelerates as the piston approaches top dead center and bottom dead center.

9. The pump of claim 1, wherein the piston retainer, cam follower, circular cam roller, cam, and camshaft are situated in the housing that is connected to the pump body, and a camshaft bearing in the housing supports rotation of the cam shaft.

10. The pump of claim 1, wherein the piston retainer, the cam follower, the circular cam roller, the cam, and the cam shaft are situated in the housing that is connected to the pump body where the variable speed electric motor is situated.

11. A high pressure fuel supply pump for a gasoline direct injection engine, comprising:

a pump body;

a single pumping bore in the body, partially defining a pumping chamber;

a single pumping piston reciprocating in the bore along an actuation axis, with one end further defining the pumping chamber and another end projecting out of the body for reciprocal driving by a rotating circular cam;

an inlet valve connected to the body, wherein the inlet valve is in fluid communication with the pumping chamber;

an outlet check valve connected to the body for discharging pressurized fuel from the pumping chamber through the body during a pumping stroke of the piston;

a cam shaft outside the body, extending along a cam shaft axis that is perpendicular to and intersects the actuation axis;

the circular cam rigidly connected to the cam shaft, having a cam axis that is perpendicular to and intersects the actuation axis, and is offset from the cam shaft axis;

a circular cam roller surrounding the cam;

a cam roller bearing interposed between the circular cam roller and the cam;

a cam follower connected to the piston, wherein the cam follower includes a roller that contacts the circular cam roller with a mutually rolling relationship as the cam rotates;

a piston retainer operatively connected among the piston, the cam follower and the circular cam roller for biasing the piston and cam follower toward the circular cam roller; and a variable speed electric motor operatively connected to said cam shaft, wherein the variable speed electric motor is configured to rotate said cam shaft and said circular cam independently of an engine crankshaft of the gasoline direct injection engine when the gasoline direct injection engine is running, whereby as the cam shaft continuously rotates, the circular cam roller rotates eccentrically relative to the cam shaft and through the piston retainer and cam follower, converts the rotating motion of the cam shaft into a linearly reciprocal stroke of the piston in the pumping chamber;

wherein the pump is connected to a fuel supply circuit including a common rail;

wherein the fuel supply circuit is connected to an electronic control unit that receives input signals commensurate with fuel pressure in the common rail and engine speed; and wherein the electronic control unit delivers a control signal to the variable speed electric motor for rotating the cam at a speed different from the engine speed.

12. The pump of claim 11 wherein the cam shaft is free of any connection to the crankshaft of the gasoline direct injection engine.

13. The pump of claim 11, wherein the electronic control unit is further configured to receive input signals commensurate with a rotational position of the cam.

14. The pump of claim 11, wherein the piston retainer, the cam follower, the circular cam roller, the cam, and the cam shaft and the variable speed electric motor are situated in a housing that is connected to the pump body.

15. A high pressure fuel supply pump for a gasoline direct injection engine, comprising:

a pump body;

a single pumping bore in the body, partially defining a pumping chamber;

a single pumping piston reciprocating in the bore along an actuation axis, with one end further defining the pumping chamber and another end projecting out of the body for reciprocal driving by a rotating circular cam;

an inlet valve connected to the body, wherein the inlet valve is in fluid communication with the pumping chamber;

an outlet check valve connected to the body for discharging pressurized fuel from the pumping chamber through the body during a pumping stroke of the piston;

a cam shaft outside the body, extending along a cam shaft axis that is perpendicular to and intersects the actuation axis;

the circular cam rigidly connected to the cam shaft, having a cam axis that is perpendicular to and intersects the actuation axis, and is offset from the cam shaft axis;

a circular cam roller surrounding the cam;

a cam roller bearing interposed between the circular cam roller and the cam;

a cam follower connected to the piston, wherein the cam follower includes a roller that contacts the circular cam roller with a mutually rolling relationship as the cam rotates;

a piston retainer operatively connected among the piston, the cam follower and the circular cam roller for biasing the piston and cam follower toward the circular cam roller; and a variable speed electric motor operatively connected to said cam shaft, wherein the variable speed electric motor is configured to rotate said cam shaft at a speed independent of a rotational speed of an engine crankshaft of the gasoline direct injection engine and independent of any rotational speed corresponding to the rotational speed of the engine crankshaft of the gasoline direct injection engine, whereby as the cam shaft continuously rotates, the circular cam roller rotates eccentrically relative to the cam shaft and through the piston retainer and cam follower, converts the rotating motion of the cam shaft into a linearly reciprocal stroke of the piston in the pumping chamber.

16. The pump of claim 15 wherein the variable speed electric motor is configured to rotate said cam shaft at a speed different from any rotational speed corresponding to the rotational speed of the engine crankshaft when the engine is running.

17. The pump of claim 15, wherein the pump is connected to a fuel supply circuit including a common rail;

the fuel supply circuit is connected to an electronic control unit that receives input signals commensurate with fuel pressure in the common rail, engine speed, and a rotational position of the cam; and the electronic control unit delivers a control signal to the variable speed electric motor for rotating the cam at a speed different from the engine speed.

18. The pump of claim 15, wherein the piston retainer, the cam follower, the circular cam roller, the cam, and the cam shaft and the variable speed electric motor are situated in a housing that is connected to the pump body.

* * * * *